United States Patent [19]

Benoit

[11] 4,114,949

[45] Sep. 19, 1978

[54] SEATING ARRANGEMENT

[75] Inventor: Roland A. Benoit, Danielson, Conn.

[73] Assignee: InterRoyal Corporation, New York, N.Y.

[21] Appl. No.: 796,799

[22] Filed: May 13, 1977

[51] Int. Cl.[2] ..... A47C 1/12

[52] U.S. Cl. ..... 297/445; 297/232

[58] Field of Search ..... 297/232, 248, 422, 440, 297/441, 443, 444, 445

[56] References Cited

U.S. PATENT DOCUMENTS

| | | | |
|---|---|---|---|
| 2,089,818 | 8/1937 | Terker | 297/440 |
| 3,310,343 | 3/1967 | Schultz | 297/445 |
| 3,318,635 | 5/1967 | Barecki et al. | 297/445 X |
| 3,343,870 | 9/1967 | Thatcher et al. | 297/232 |
| 3,913,978 | 10/1975 | Lester et al. | 297/445 |

*Primary Examiner*—James C. Mitchell
*Attorney, Agent, or Firm*—Arthur A. March

[57] ABSTRACT

A seating arrangement comprising a pair of parallel laterally spaced solid block support members interconnected by two suspension rods, one extending between the front central portions of the support members and the other between the top rearward portions of the support members, a composite seat portion and backrest portion extending at an angle to each other, the seat portion being secured to the suspension rod extending between the front central portions of the support members and the backrest portion being secured to the suspension rod extending between the top rearward portions of the support members to provide a free floating chair with distributed balance.

13 Claims, 4 Drawing Figures

SEATING ARRANGEMENT

BACKGROUND OF THE INVENTION

There has long been a desire for seating arrangements which support the user in a safe and comfortable fashion while nevertheless being relatively inexpensive to mass produce. Heretofore various proposals have been made to attempt to achieve this desired result in the most economic fashion. However, for reasons of lack of an effective combination of safety, comfort, economy and durability, such proposals have not been completely satisfactory. The highly desirable provision of a seating arrangement which while possessing all of the foregoing attributes is also esthetically appealing, has also not been achieved.

Efforts to accomplish the desired structure are shown in U.S. Pat. Nos. 724,583; 1,842,054; 2,454,912; 2,667,916; D-154,355; D-154,356; 2,914,115; 3,343,870; 3,619,004; 3,630,566; 3,640,576; 3,677,601; 3,690,723; 3,844,612; 3,873,155; 3,856,353.

As a consequence, it is the primary object of this invention to provide a seating arrangement which is relatively simple and economical to manufacture; safe, sturdy and durable in construction; comfortable to use and highly attractive in appearance.

SUMMARY OF THE INVENTION

The invention achieves the foregoing objects by providing a pair of parallel and laterally spaced upright end support members having forward, rearward, top and bottom portions. A suspension rod adapted to bear a structural load is mounted by its end portions in the forward areas of the aforesaid end support members at a level substantially intermediate the top and bottom portions thereof. A horizontally extending linear structural load-bearing suspension rod has its end portions mounted on the rearward portions of the end support members in the vicinity of the rear top portions thereof. A composite seat and back frame including a forward seat frame portion which defines a substantially horizontal seat area and a rearward back frame portion defining a substantially upright backrest area are supported by the aforesaid rods and disposed at an angle to each other. The rearward back frame portion and the forward seat frame portion are inter-connected with each other to form a composite frame. The forward seat frame portion is disposed downwardly against and is connected to the seat accommodating rod in load transmitting contact therewith. The rearward back frame portion is disposed rearwardly against and is connected to the backrest accommodating rod in load transmitting contact therewith. A seat element is disposed in the seat area and connected to the forward frame portion in load distributing relation therewith and a backrest element is disposed in the backrest area and is connected to the rearward frame portion in load distributing relation therewith.

This structure provides a free floating chair capable of transmitting the load of the user in forward and rearward distributed balance in a comfortable economic and esthetically pleasing way.

The invention will hereinafter be described in relation to specific embodiments of the invention as shown in the drawings which are not at all to be construed as limiting the scope of the invention.

DETAILED DESCRIPTION OF THE INVENTION

Figure 1:
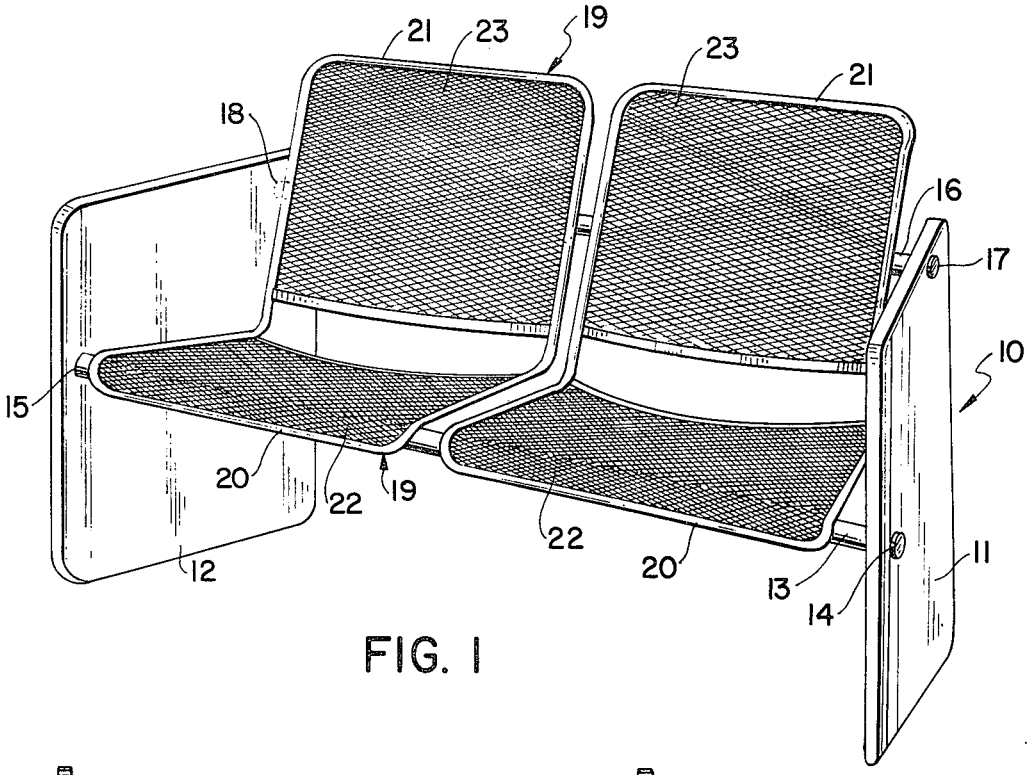
FIG. 1 is a front perspective view of the chair of the present invention.

Referring specifically to the drawings, there is shown a seating arrangement 10 comprising spaced apart upright end support members 11 and 12 which have forward, rearward, top and bottom portions. The support members are shown in the form of solid blocks of material which can be of wood, plastic or any other suitable material. However, it is to be understood that the inventive concept is not limited to the provision of solid blocks of material and the support or truss members may comprise, for example, a retangular frame with a central open portion or any other shape and form suitable for the supporting function hereinafter described.

A substantially horizontal linear structural load bearing suspension rod 13 interconnects the support truss members 11 and 12. The connection is preferably established by mounting the ends of the rod in secured fashion at the forward portions of the support members 11 and 12 at a level 14 and 15 intermediate the top and bottom portions of the support members.

Another substantially horizontally extending linear structural load-bearing rod 16 interconnects the support truss members 11 and 12. This connection is established by mounting of the ends of the rod 16 in secured fashion on the rearward portions of the support members at a level 17 and 18 in the vicinity of the top portions of the support members. Thus a braced, self-sustaining structure is provided by the invention created by the self-supporting end support members 11 and 12 and the interconnecting rods 13 and 16. This structure has been found to be extremely sturdy and durable.

Figure 2:
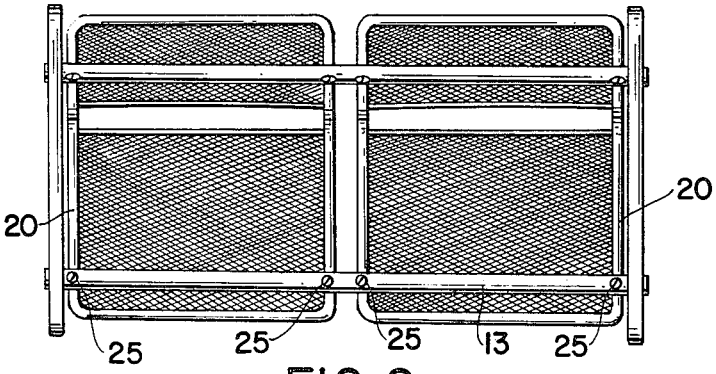
FIG. 2 is a bottom view of the chair invention.
Figure 3:
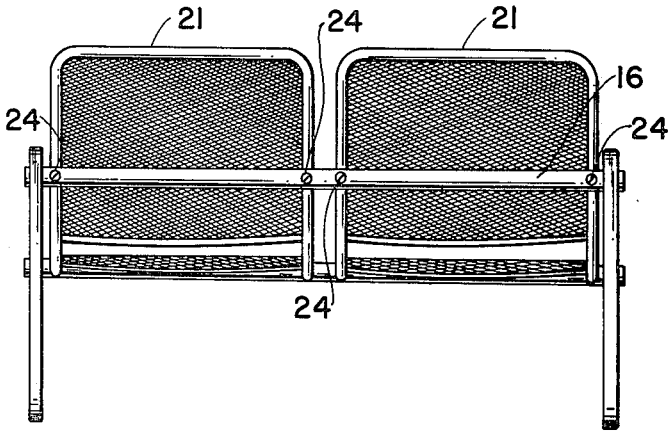
FIG. 3 is a rear view of the chair invention.

In accordance with the present invention, a unitary composite free floating chair is provided in the following manner. A composite seat and back frame 19 is provided which is preferably of tubular material. This structure is thus easily formed into the shape desired. The chair of FIGS. 1–3 is constructed so as to accommodate two people as will be described accordingly. The composite frame has forward seat frame portions 20 which define substantially horizontal seat areas and rearward back portions 21 defining substantial upright backrest areas disposed at an angle with respect to the seat frame portions.

It is to be noted that each rearward back frame portion 21 is interconnected integrally and rigidly with its forward seat frame portion 20 to provide such a composite frame. The forward seat frame portions 20 are disposed downwardly against and connected to the seat accommodating rod 13 in load transmitting contact therewith. The rearward back frame portions 21 are disposed rearwardly against and connected to the backrest accommodating rod 16 in load transmitting contact therewith.

As illustrated, seat elements 22 are located in the seat areas connected to the forward frame portions 20 also in load distributing relation therewith. Backrest elements 23 are disposed in the back areas connected to the rearward frame portions 21 in load distributing relation therewith.

The rearward frame portions 21 are securable to the backrest accommodating rod 16 by a suitable standard nut and bolt arrangement 24 as illustrated in FIG. 3.

The seat frame portions are connected to the seat accommodating rod 13 by welding or standard nut and bolt arrangements 25 as shown in FIG. 2.

With this construction, there is a distribution of the load over the entire area of the chair. Thus a free floating chair which is capable of transmitting the load of the user in forward and rearward distributed balance of the suspension rods and, in turn, laterally to the end support truss members is accomplished. As illustrated, the chair is of an open network but of course any suitable back and seat means may be utilized. As further illustrated, the back and seat means are separated from each other by a gap which enhances the comfort and openness of the seating arrangement itself.

While a surrounding frame 19 has been described in connection with the chair of the invention, it is possible to provide such a free floating chair without a separate frame. This can be done by providing a direct attachment between the backrest portion itself and the seat portion itself and the respective rods 13 and 14.

Figure 4:
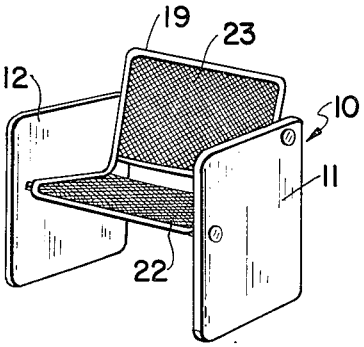
FIG. 4 is a front view of a modified form of the chair.

As illustrated in FIG. 4, the entire seating arrangement 10 may comprise single seat and backrest portions 22 and 23 within the composite frame 19 as well as the two section arrangement illustrated in FIGS. 1–3. In this single seat construction, the rods 13 and 16 are shorter in length but otherwise the chair structure is substantially the same as above described. By the foregoing means, a novel and distinctive seating arrangement has been provided by the present invention which is economic, safe, durable and extremely attractive.

While the invention has been described in some detail, it is to be understood that variations and modifications may be made without departing from the scope of the invention as defined in the appended claims.

What is claimed is:

1. Free floating chair comprising a pair of side by side and laterally spaced apart upright end support truss members having corresponding forward, rearward, top and bottom portions and adapted to support a load with the bottom portions thereof resting on a support surface, a substantially horizontally extending linear structural load bearing seat accommodating suspension rod correspondingly mounted in suspension at its end portions on the forward portions of the end support members at a level intermediate the top and bottom portions thereof, a substantially horizontally extending linear structural load bearing backrest accommodating suspension rod correspondingly mounted in suspension at its end portions on the rearward portions of the end support members at a level in the vicinity of the top portions thereof, at least one unitary composite seat and back portion defining a substantially horizontal seat area and a substantially upright backrest area and disposed at an angle with respect thereto, the rearward back portion and the forward seat portion being interconnected rigidly with each other and, in turn, the forward seat portion being disposed downwardly against and connected to the seat accommodating rod in load transmitting contact therewith and the rearward back portion being disposed rearwardly against and connected to the backrest accommodating rod in load transmitting contact therewith, whereby to provide a free floating chair capable of transmitting the load of the user in forward and rearward distributed balance correspondingly via the seat portion and backrest portion to the seat accommodating suspension rod and backrest accommodating suspension rod and in turn in laterally distributed balance correspondingly via the suspension rods to the end support truss members.

2. Chair according to claim 1 wherein the seat portion and the backrest portion are spaced apart from each other within a common interconnecting frame.

3. Free floating chair comprising a pair of side by side and laterally spaced apart upright end support truss members having corresponding forward, rearward, top and bottom portions and adapted to support a load with the bottom portions thereof resting on a support surface, a substantially horizontally extending linear structural load bearing seat accommodating suspension rod correspondingly mounted in suspension at its end portions on the forward portions of the end support members at a level intermediate the top and bottom portions thereof, a substantially horizontally extending linear structural load bearing backrest accommodating suspension rod correspondingly mounted in suspension at its end portions on the rearward portions of the end support members at a level in the vicinity of the top portions thereof, at least one unitary composite seat and back frame including a forward seat frame portion defining a substantially horizontal seat area and a rearward back frame portion defining a substantially upright backrest area and disposed at an angle with respect thereto, the rearward back frame portion and the forward seat frame portion being interconnected integrally with each other to provide such composite frame and, in turn, the forward seat frame portion being disposed downwardly against and connected to the seat accommodating rod in load transmitting contact therewith and the rearward back frame portion being disposed rearwardly against and connected to the backrest accommodating rod in load transmitting contact therewith, and a seat element disposed in the seat area and connected to the forward frame portion in load distributing relation therewith and a backrest element disposed in the backrest area and connected to the rearward frame portion in load distributing relation therewith, whereby to provide a free floating chair capable of transmitting the load of the user in forward and rearward distributed balance correspondingly via the seat element and backrest element to the seat accommodating suspension rod and backrest accommodating suspension rod and, in turn, in laterally distributed balance correspondingly via the suspension rods to the end support truss members.

4. Chair according to claim 3 wherein the rods are hollow rods and the frame portions of the composite seat and back frame are formed of hollow tubing.

5. Chair according to claim 3 wherein the forward edge portion of the forward seat frame portion is positioned adjacent to and curves downwardly in covering relation over the corresponding portion of the seat accommodating rod thereat.

6. Chair according to claim 3 wherein the upper edge portion of the rearward back frame portion extends upwardly beyond the level of the corresponding portion of the backrest accommodating rod thereat.

7. Chair according to claim 6 wherein the backrest accommodating rod is positioned substantially intermediate the corresponding upper edge portion and lower edge portion of the rearward back frame portion.

8. Chair according to claim 3 wherein the seat element and the backrest element are formed of web material.

9. Chair according to claim 3 wherein the composite frame is in the form of a unitary frame of hollow tubing.

10. Chair according to claim 9 wherein the unitary frame is in the form of an angular perimetric endless tube.

11. Free floating chair comprising a pair of side by side and laterally spaced apart upright solid block end support truss members having corresponding forward, rearward, top and bottom portions and adapted to self-support a load with the bottom portions thereof resting in self-sustaining disposition on a support surface, a substantially horizontally extending linear structural load bearing seat accommodating hollow suspensions rod correspondingly bilaterally mounted in suspension at its end portions on the forward portions of the end support members at a level intermediate the top and bottom portions thereof, a substantially horizontally extending linear structural load bearing backrest accommodating hollow suspension rod correspondingly bilaterally mounted in suspension at its end portions on the rearward portions of the end support members at a level in the vicinity of the top portions thereof, at least one unitary composite seat and back frame including a unitary angular perimetric endless hollow tube having a forward seat frame portion defining a substantially horizontal seat area and a rearward back frame portion defining a substantially upright backrest area spaced from the seat area and disposed at an angle with respect thereto, the rearward back frame portion and the forward seat frame portion being interconnected integrally rigidly with each other by the unitary tube to form such composite frame, and in turn the forward seat frame portion being disposed downwardly against and connected to the seat accommodating rod in load transmitting contact therewith and the rearward back frame portion being disposed rearwardly against and connected to the backrest accommodating rod in load transmitting contact therewith, and a seat element formed of web material disposed in the seat area and connected to the forward frame portion in load distributing relation therewith and a backrest element formed of web material disposed in the backrest area and connected to the rearward frame portion in load distributing relation therewith, whereby to provide a free floating chair capable of transmitting the load of the user in forward and rearward distributed balance correspondingly via the seat element and backrest element to the seat accommodating suspension rod and backrest accommodating suspension rod and in turn in bilaterally distributed balance correspondingly via the suspension rods to the end support truss members.

12. Chair according to claim 11 wherein the forward edge portion of the forward seat frame portion is positioned adjacent to and curves downwardly in covering relation over the corresponding portion of the seat accommodating rod thereat, and the upper edge portion of the rearward back frame portion extends upwardly beyond the level of the corresponding portion of the backrest accommodating rod thereat.

13. Chair according to claim 12 wherein the backrest accommodating rod is positioned in relation to the rearward back frame portion substantially intermediate the corresponding upper edge portion and lower edge portion of the rearward back frame portion.

* * * * *